US006561159B1

(12) United States Patent
Mower et al.

(10) Patent No.: US 6,561,159 B1
(45) Date of Patent: May 13, 2003

(54) CRANKCASE INDUCTED SELF-SUPERCHARGING FOUR CYCLE INTERNAL COMBUSTION ENGINE

(76) Inventors: Louis W Mower, P.O. Box 672109, Chugiak, AK (US) 99567; Konrad L. Mower, P.O. Box 672109, Chugiak, AK (US) 99567

( * ) Notice: Subject to any disclaimer, the term of this patent is extended or adjusted under 35 U.S.C. 154(b) by 0 days.

(21) Appl. No.: 10/044,758

(22) Filed: Jan. 9, 2002

Related U.S. Application Data

(63) Continuation-in-part of application No. 09/733,408, filed on Dec. 5, 2000, now Pat. No. 6,338,328.

(51) Int. Cl.[7] ..... F02B 75/02
(52) U.S. Cl. ..... 123/317; 123/318
(58) Field of Search ..... 123/317, 318

*Primary Examiner*—Noah P. Kamen
(74) *Attorney, Agent, or Firm*—Michael J. Tavella

(57) ABSTRACT

A crankcase inducted self-supercharging four-cycle internal combustion engine that uses cylinder pairs as an induction pump. The cylinder pairs are arranged in a 360-degree crank throw so that both pistons rise and fall together. The system uses two valves and two tubes force air into the crankcase and then into the cylinders in a supercharged mode. It can also operate with both valves closed in a naturally aspirated mode. In this case, air is directed directly into the cylinder through an intake manifold.

8 Claims, 10 Drawing Sheets

CRANKCASE INDUCTED SELF-SUPERCHARGING FOUR CYCLE INTERNAL COMBUSTION ENGINE

CROSS REFERENCE TO RELATED APPLICATIONS

This is a continuation in part of application Ser. No. 09/733,408, filed Dec. 5, 2000, now U.S. Pat. No. 6,338,328.

STATEMENT REGARDING FEDERALLY SPONSORED RESEARCH AND DEVELOPMENT

Not Applicable

BACKGROUND OF THE INVENTION

1. Field of the Invention

This invention relates to self supercharging internal combustion engines and particularly to crankcase inducted self-supercharging four-cycle internal combustion engine.

2. Description of Related Art

Several patents have been issued relating to the use of the crankcase as an air chamber to enhance combustion air in an engine. These patents cover both two stroke and four stroke engines. For example, U.S. Pat. No. 3,973,532 to Litz uses a sealed crankcase to draw air into the engine. This air is then compressed and stored in a holding tank, where it is drawn into the cylinder on the intake stroke. This compressed air supercharges the fuel mixture before the normal compression stroke. One problem with this design is that it requires a separate sir tank to be added to the engine. Another problem is that it only draws a single charge of air over two of the cycles. While this does provide additional air, it does so inefficiently.

U.S. Pat. No. 5,377,634 to Taue teaches another engine that uses the crankcase as a compression chamber for air. Again, the problem is that the chamber is small and the amount of air being compressed and pumped is limited by what one cylinder can pump and compress. U.S. Pat. Nos. 5,230,314, 5,657,724, 4,282,845, and 4,545,346 all teach use of a crankcase as a compression chamber to compress air for combustion. They all suffer from the same volume limitations that limit the amount of air that can be compressed to that produced by one cylinder.

U.S. Pat. No. 5,105,775 takes the use of the crankcase combustion chamber in a slightly different direction. Here, the crankcase is divided into a number of sealed chambers. Adjacent chambers are interconnected. Because of the timing differences between the cylinders, this allows one cylinder to charge the other cylinder and vice versa. This then eliminates the need for a separate holding tank, because each cylinder's crankcase acts as the holding tank for the other. Despite the reduction in equipment needed, the fundamental limitation remains in that the air being compressed remains that volume that can be handled by one cylinder.

BRIEF SUMMARY OF THE INVENTION

The instant invention is a crankcase inducted self-supercharging four-cycle internal combustion engine that uses cylinder pairs to as an induction pump. The cylinder pairs are arranged in a 360-degree crank throw so that both pistons rise and fall together. The cylinders are synchronized so that when one cylinder is on the intake stroke, the other is on the power stroke. When one cylinder is on the exhaust stroke, the other is on the compression stroke.

A two-cycle reed valve is installed on a crankcase inlet port to draw air into the crankcase on the upstroke of the pistons. Since both pistons rise and fall together, each upstroke draws a volume of air equal to the volume of two pistons into the crankcase. When both pistons are on the down stroke, this double volume of air is then moved into a manifold connecting the crankcase to the inlet valves of the cylinders. This air is then pumped into each cylinder alternately on each intake stroke. In this way, it is possible to increase the air available for each cylinder by a factor of two without having to resort to storage tanks or other devices. Moreover, there is no wasted movement in compressing the air because each intake stroke draws in twice the volume of one cylinder. The double volume of air is then delivered into one cylinder, which automatically compresses the air in the cylinder without having to store it or compress it separately.

DETAILED DESCRIPTION OF THE INVENTION

Figure 1:
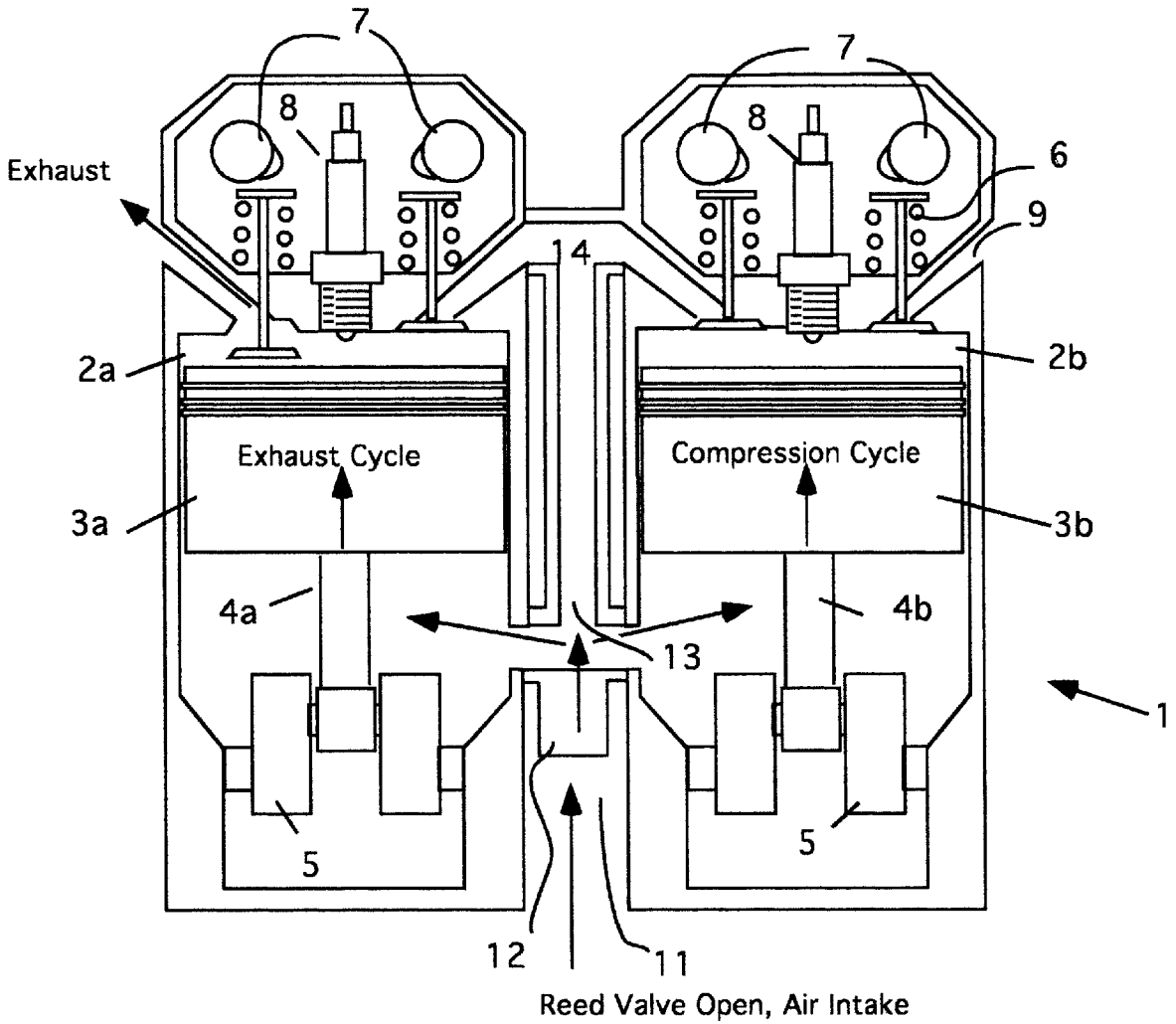
FIG. 1 is a cross-sectional front view of a pair of cylinders showing the pistons moving upward as part of the exhaust and compression cycles.

Referring now to FIG. 1, a cylinder pair 1 is shown. The cylinder pair 1 has two piston chambers, designated as 2*a* and 2*b*. In each piston chamber is a piston, designated as 3*a* and 3*b*. Each piston is connected to a crank 5 with connecting rods 4*a* and 4*b*. The upper portion of each piston chamber has intake and exhaust valves 6 cams 7 and a spark plug 8, which are common to the art. Each piston chamber has an exhaust outlet 9 as well.

At the lower end of the cylinder pair 1 is a crankcase chamber 10. As shown, this chamber extends under both pistons. At the center of the crankcase chamber is an inlet port 11 and a reed valve 12. An inlet tube 13 also rises from the crankcase chamber to the top of the cylinder pair. This tube then bifurcates to form the inlet ports 14 for the each piston chamber.

FIG. 1 shows both pistons moving upward. Piston chamber 2*a* is in the exhaust stroke while piston chamber 2*b* is in the compression stroke. At this time, the reed valve 12 opens, allowing air to flow into the crankcase chamber. Because the intake valves are closed, the air is trapped in the crankcase chamber.

Figure 2:
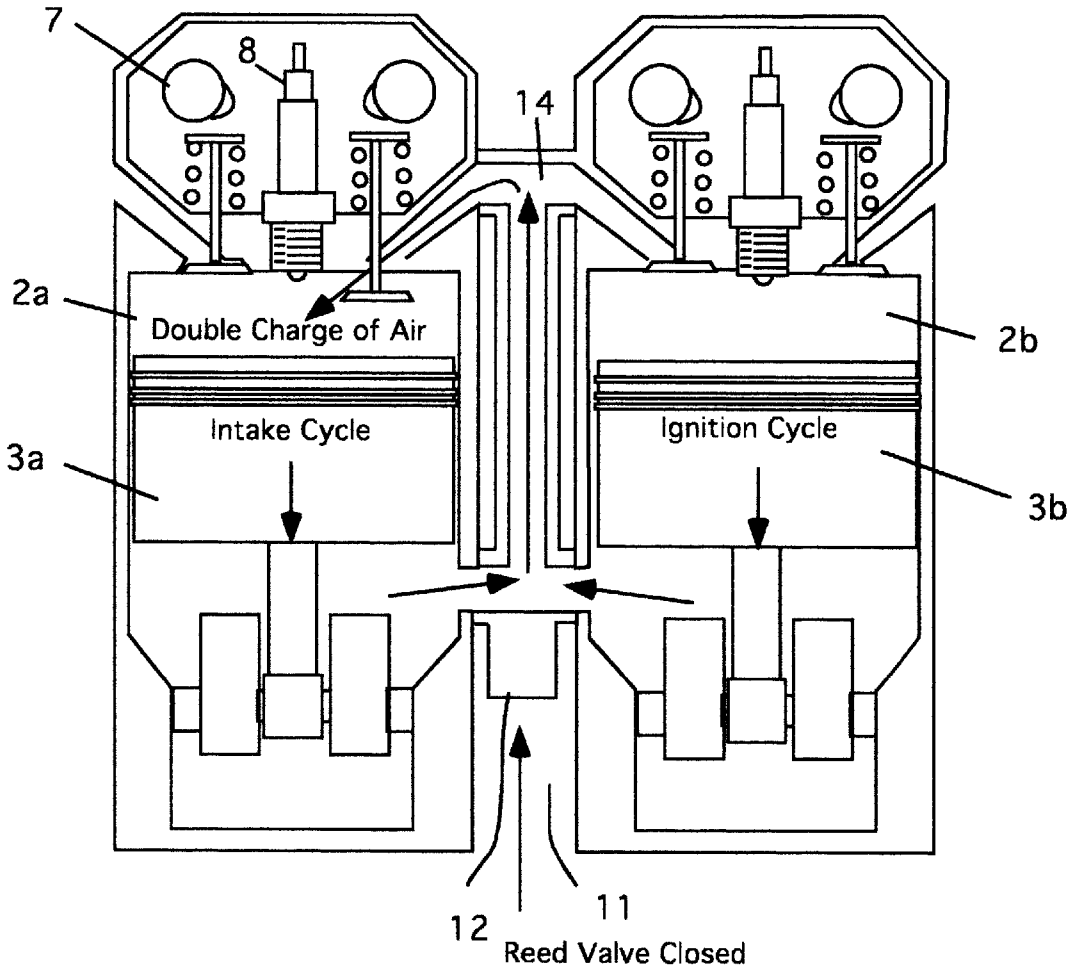
FIG. 2 is a cross-sectional front view of a pair of cylinders showing the pistons moving downward as part of the intake and ignition cycles.

FIG. 2 shows the next step in the cycle. Here, Piston chamber 2*b* has fired and is in the power stroke. Piston chamber 2*a* is in the intake stroke. As the pistons move downward, they compress the air in the crankcase chamber and, because the intake valve of piston chamber 2*a* is opened, they force the entire volume of air from the crankcase chamber into piston chamber 2*a*. This produces a double charge of air in piston chamber 2*a*. As shown, the reed valve is closed during this cycle.

Figure 3:
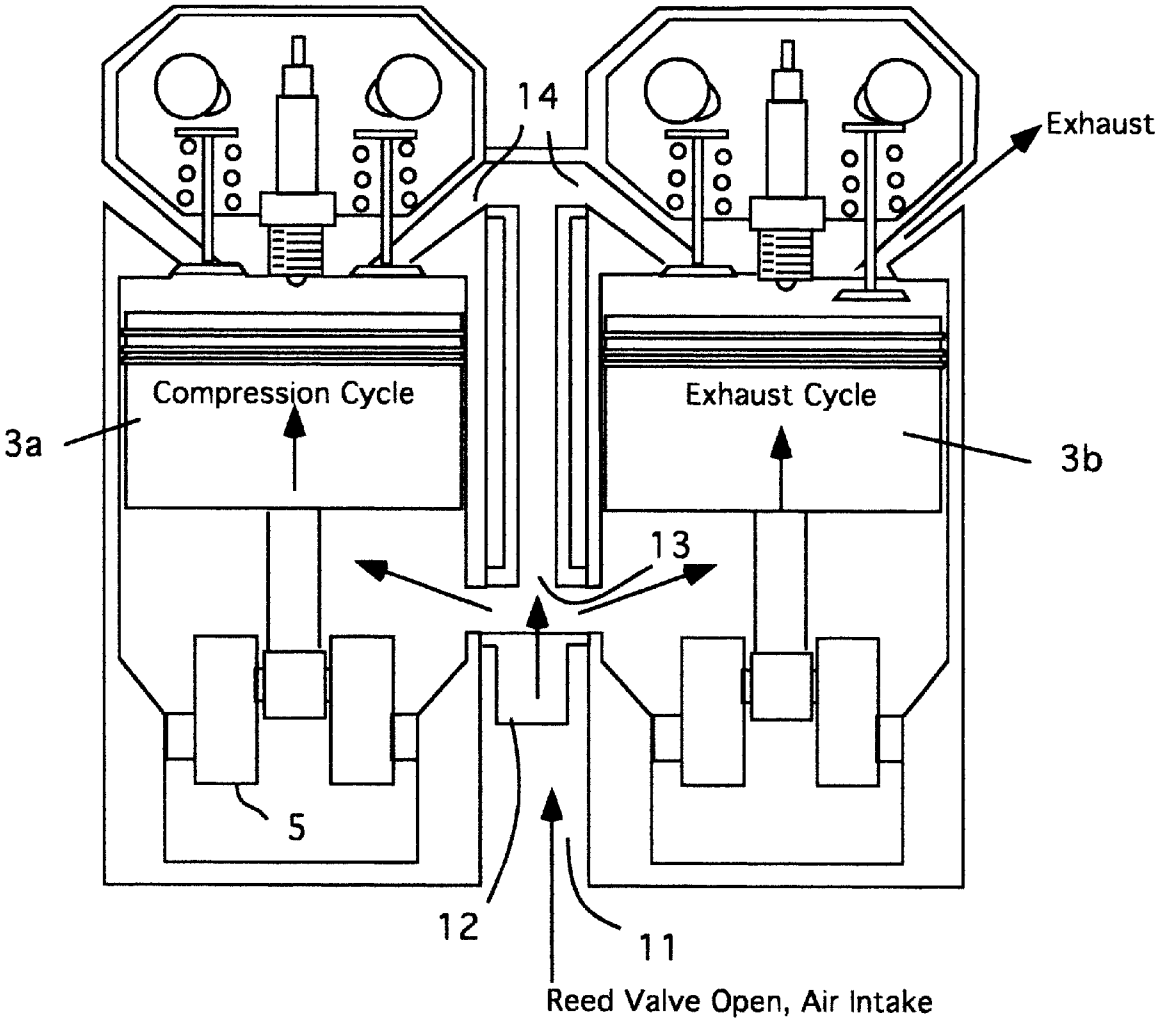
FIG. 3 is a cross-sectional front view of a pair of cylinders showing the pistons moving upward as part of the compression and exhaust cycles.

FIG. 3 shows the upward cycle of the pistons. Here, piston chamber 2*a* is in compression and piston chamber 2*b* is in exhaust. As before, the reed valve opens and a volume of air fills the crankcase chamber.

Figure 4:
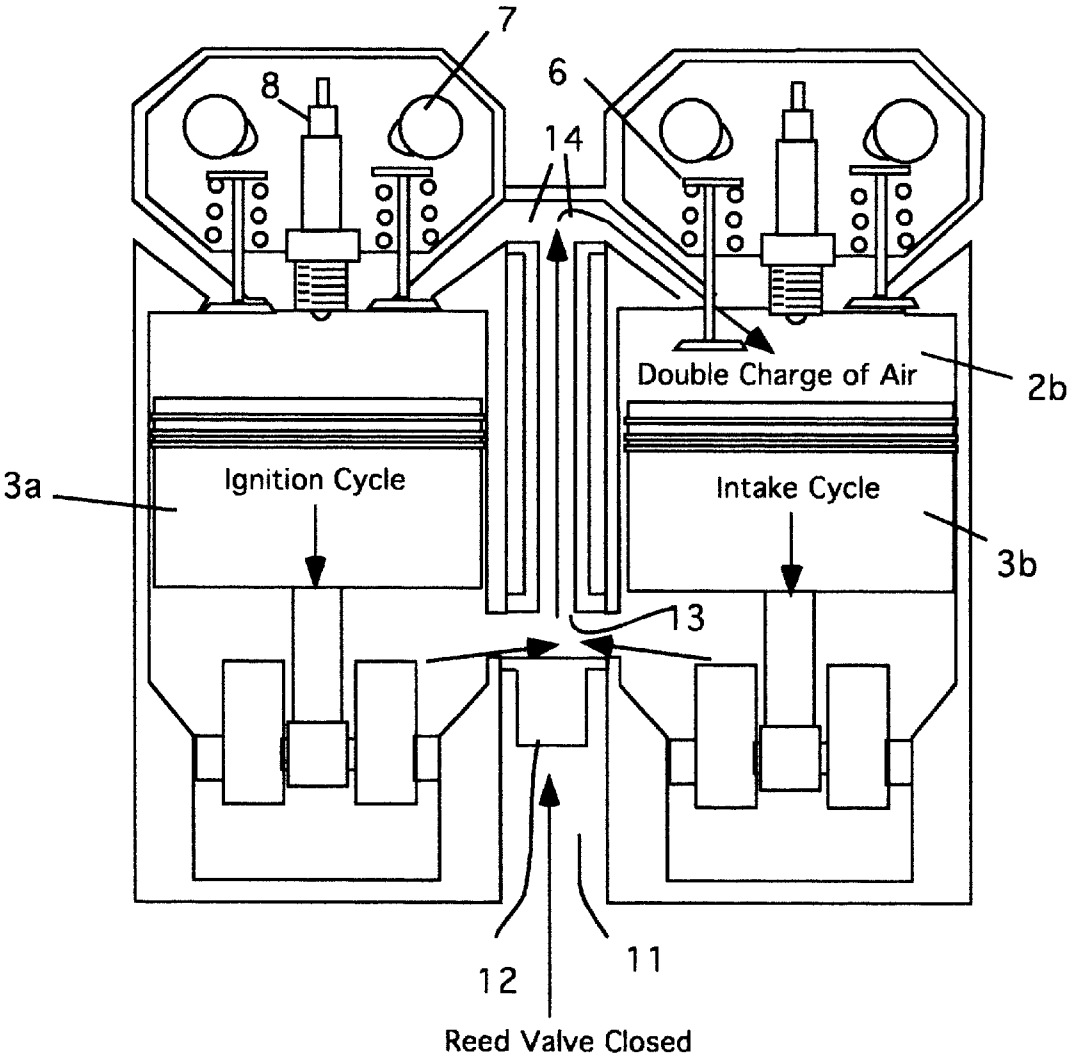
FIG. 4 is a cross-sectional front view of a pair of cylinders showing the pistons moving downward as part of the ignition and intake cycles.

Finally, FIG. 4 shows the next downward cycle, with piston chamber 2*a* having fired and is in the power stroke. Piston chamber 2*b* is in the intake stroke. As the pistons move downward, they compress the air in the crankcase chamber and, because the intake valve of piston chamber 2*b* is opened, they force the entire volume of air from the crankcase chamber into piston chamber 2*b*. This produces a double charge of air in piston chamber 2*b*. As shown, the reed valve is closed during this cycle.

This cycle is then repeated as the engine runs.

Figure 5:
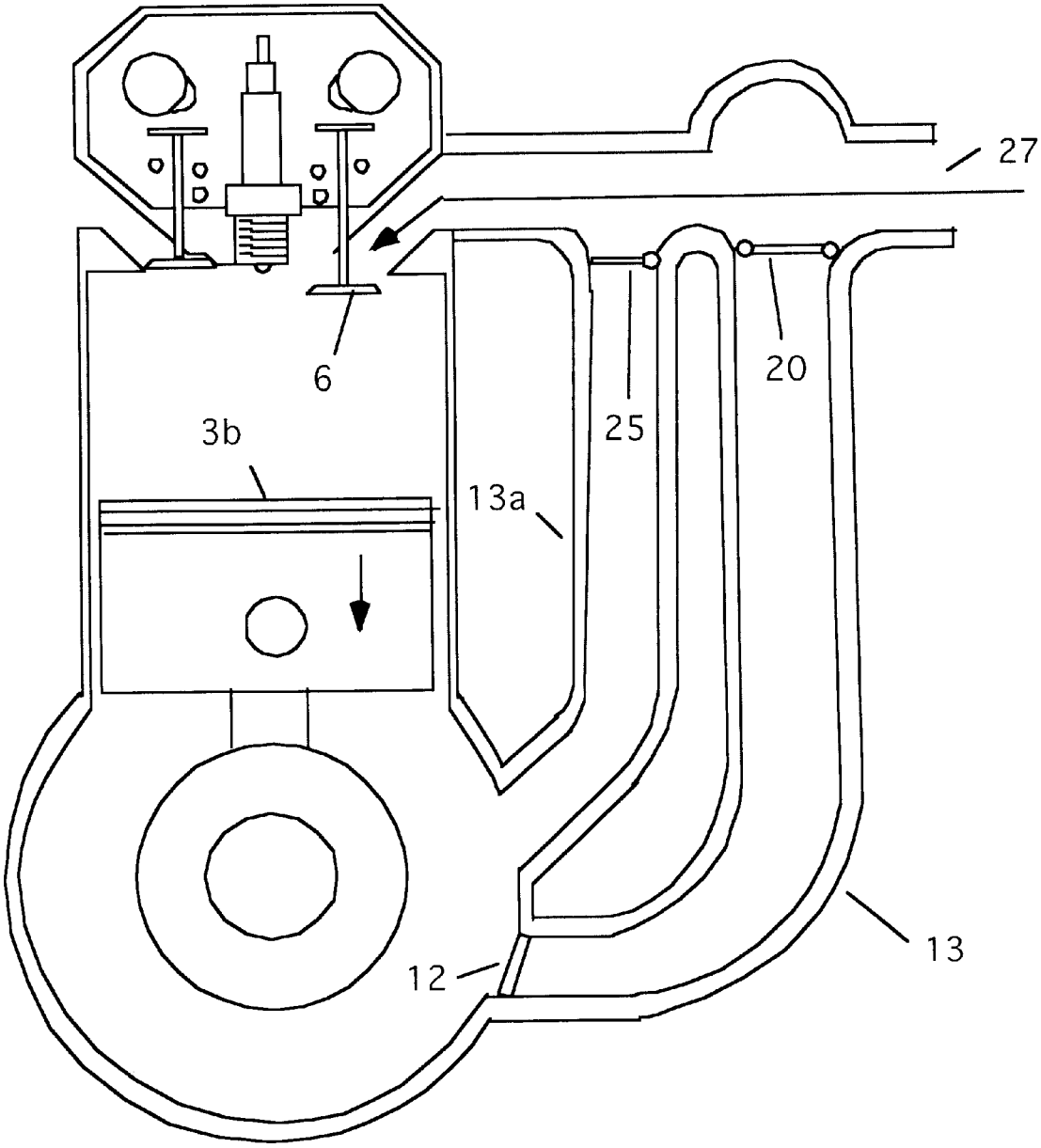
FIG. 5 is a cross-sectional side view of one of the cylinders showing the air control valves set in the naturally aspirated mode.
Figure 6:
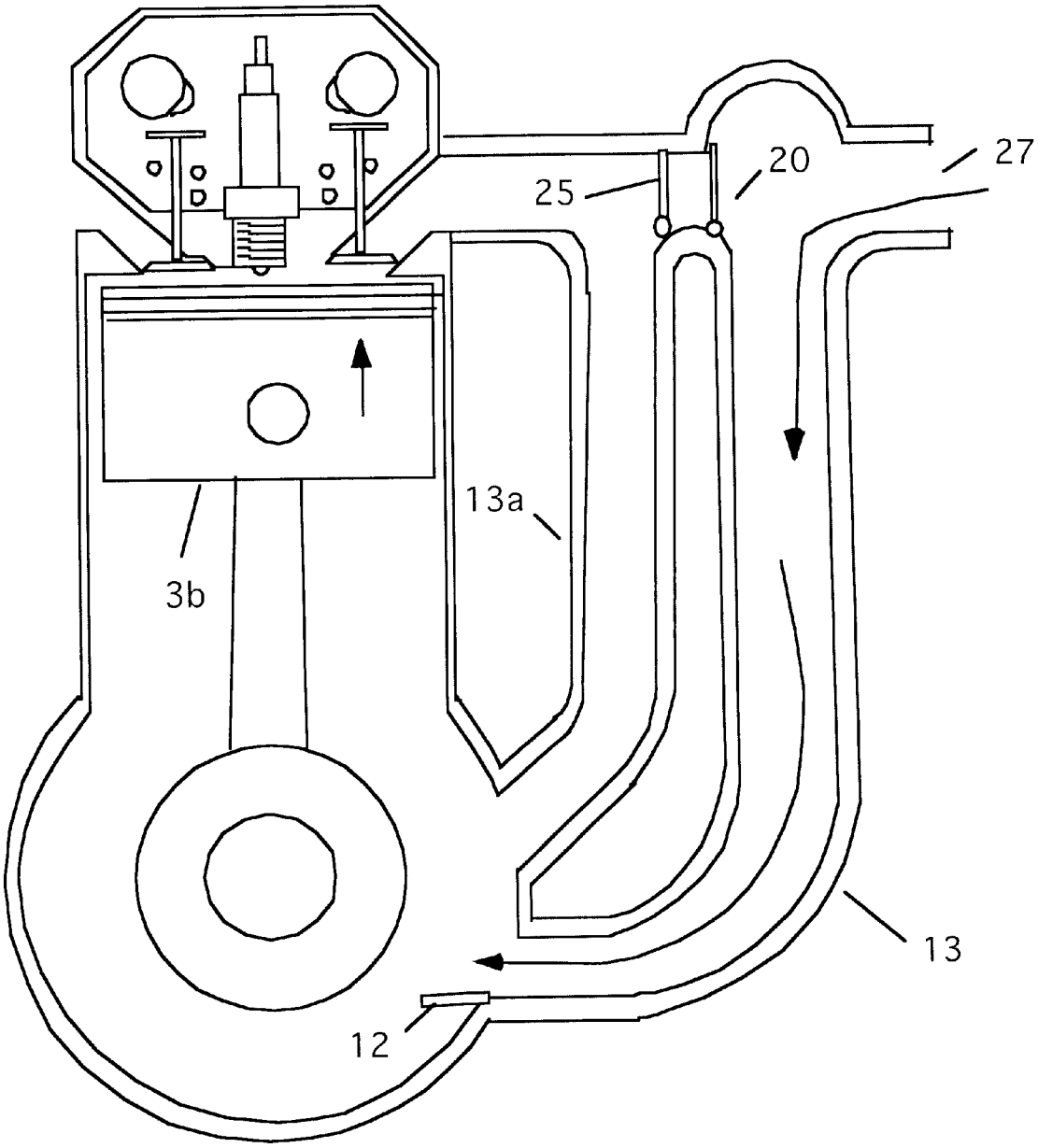
FIG. 6 is a cross-sectional side view of one of the cylinders showing the air control valves set in the supercharged mode during the crankcase-filling stroke.
Figure 7:
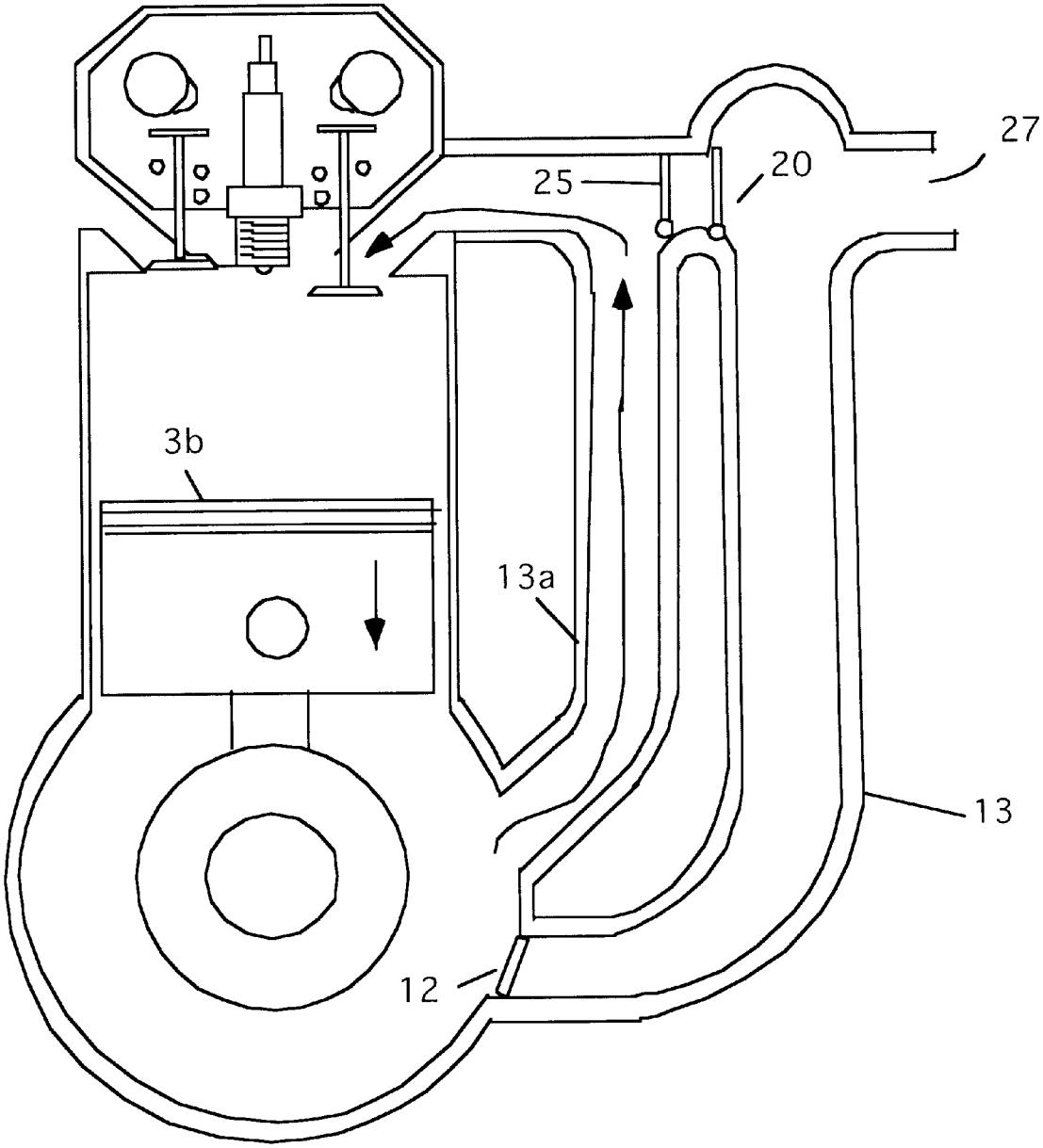
FIG. 7 is a cross-sectional side view of one of the cylinders showing the air control valves set in the supercharged mode during the intake stroke (air being fed from the crankcase).
Figure 8:
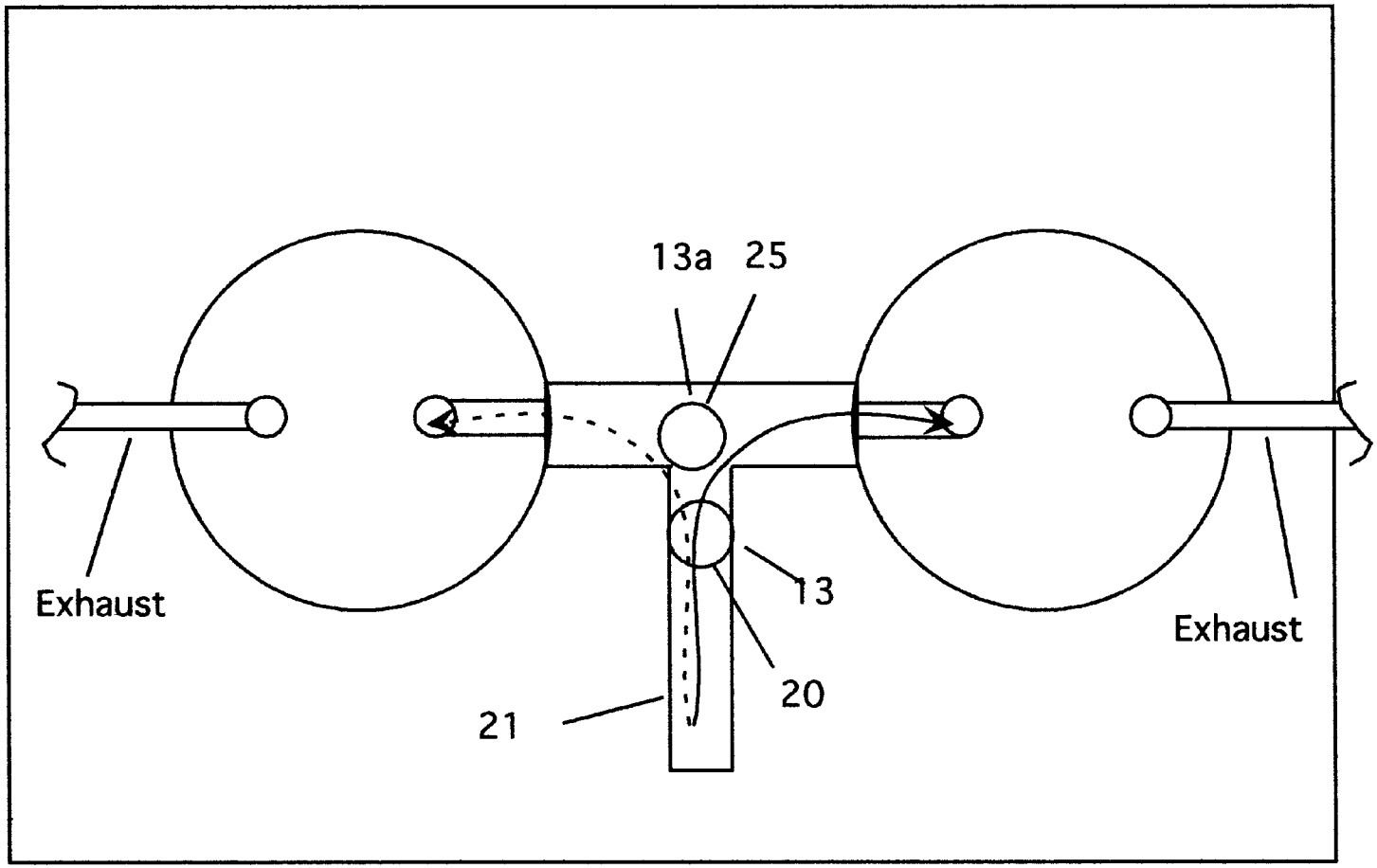
FIG. 8 is a top view of a pair of cylinders showing the air control valves set in the naturally aspirated mode.

FIGS. 5–9 show a second embodiment of the invention. In this embodiment, two valves 20 and 25 are inserted into the intake manifold 27 as shown. In this embodiment, an additional inlet tube 13*a* is used, as described below. Note that although the drawings show a pair of vertical tubes 13 and 13*a*, any configuration of passageways or tubes can be used to achieve the same purpose. In this embodiment, a first two-way valve 20 and a second two-way valve 25 are used to close the inlet tubes 13 and 13*a* so that all of the intake air is directed into the cylinder from the intake manifold 27 in a naturally aspirated mode of operation. FIGS. 5 and 8 show the naturally aspirated configuration.

Figure 9:
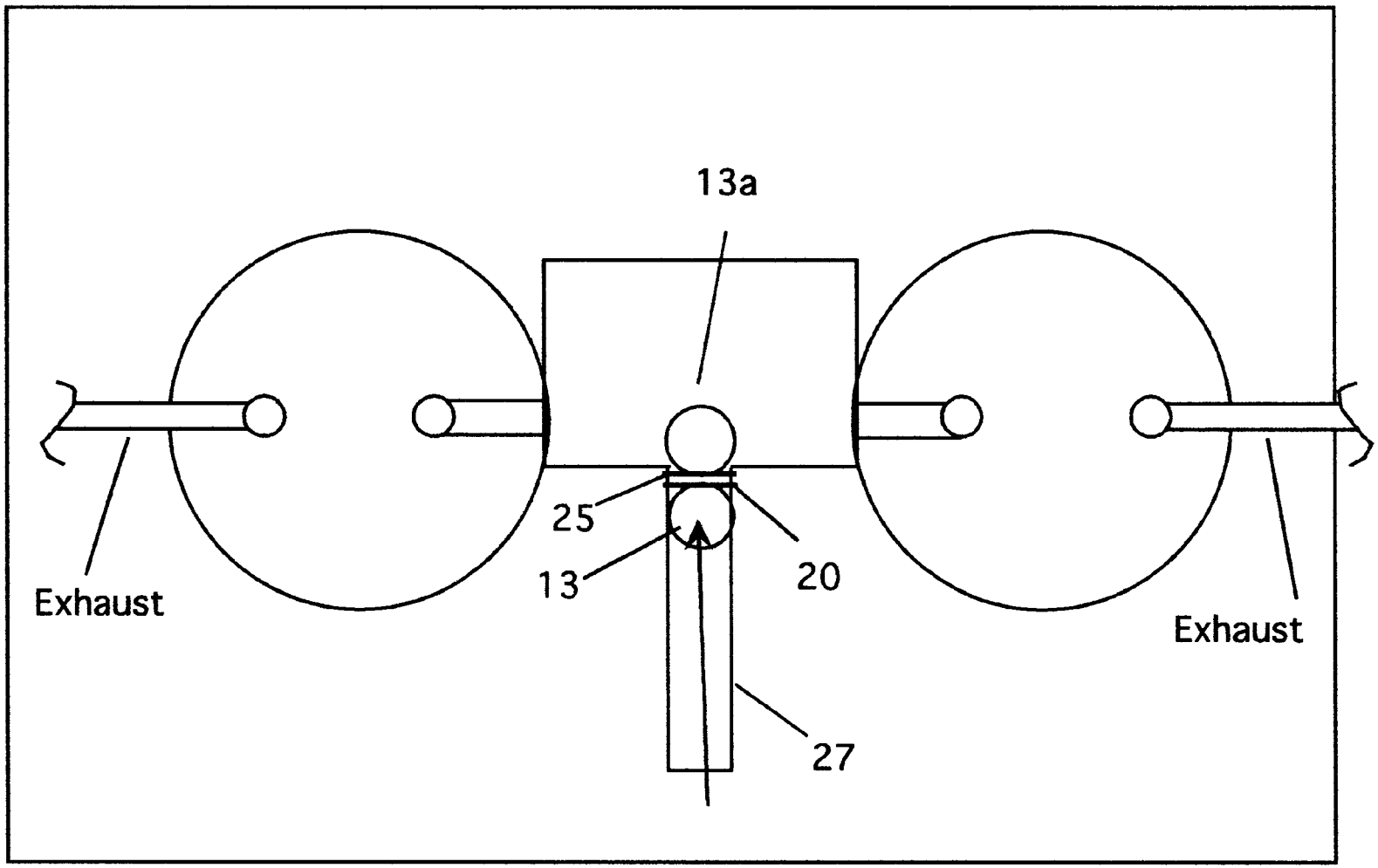
FIG. 9 is top view of a pair of cylinders showing the air control valves set in the supercharged mode during the crankcase filling operation.
Figure 10:
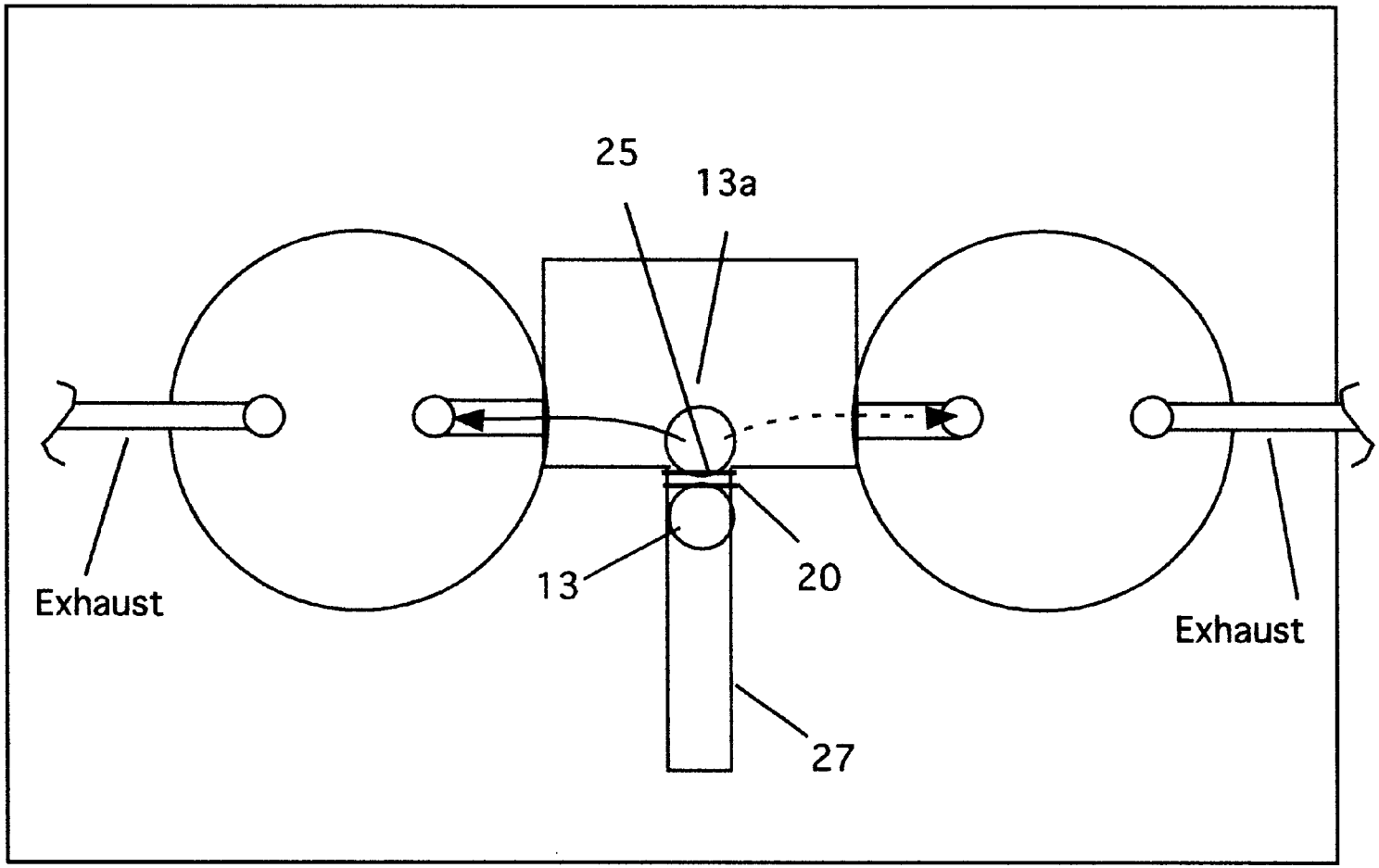
FIG. 10 is a top view of one of the pair of cylinders showing the air control valves set in the supercharged mode during the intake stroke (air being fed from the crankcase).

FIGS. 6, 7, 9 and 10 show the system in a supercharged mode. In FIGS. 6 and 9, the valves 20 and 25 are open. As a result, on the upstroke of the cylinder pair (the compression stroke of one piston and the exhaust stroke of the other), air is pulled into the crankcase through the valve 20 and tube 13. The upward movement of the piston causes the reed valve 12 to open as shown, allowing the charge of air to fill the crankcase. FIGS. 7 and 10 show the supercharged air moving from the crankcase through tube 13*a* into the cylinder. Note that valve 20 prevents any air from entering from the intake manifold 27. Note also that reed valve 12 is also closed during this operation. In this example, one of the cylinders is in the intake stroke.

FIG. 8 shows a top view of the cylinder pair in the naturally aspirated mode. As discussed above, in this configuration, the valves 20 and 25 are closed, allowing air from the crankcase to fill the cylinders through intake manifold 27. Because one cylinder is on the intake stroke while the adjacent cylinder is on the ignition stroke, the solid arrow represents a double charge of air filling a first cylinder and the dashed arrow represents a second double charge of air filling the second cylinder in the next cycle.

FIG. 9 shows a top view showing the valves 20 and 25 in the open (supercharged) position. Here, tube 13 is open to allow combustion air to flow into the crankcase from intake manifold 27. This occurs during the compression stroke of one cylinder and the simultaneous exhaust stroke of the other cylinder. As before, each arrow represents an air flow during alternate cycles.

FIG. 10 shows a top view showing the valves 20 and 25 in the open (supercharged) position. Here, tube 13*a* is open to allow combustion air to flow into the cylinder from the crankcase through tube 13*a*. This occurs during the intake stroke of one cylinder and the simultaneous power stroke of the other cylinder. As before, each arrow represents an air flow during alternate cycles.

The position of valves 20 and 25 can be set manually, or can be controlled electrically. Moreover, the valves 20 and 25 may also be controlled by a computer to adjust the operation of the engine to match the operating conditions being experienced. Although the valves are both shown operating in concert (either both open or both closed), this is the preferred embodiment. The system can operate with valve 25 operating independently of valve 20, but that increases control operation and can be expensive and inefficient.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A crankcase inducted self-supercharging four-cycle internal combustion engine comprising:

a) at least one cylinder pair having two pistons arranged in a 360-degree crank throw, whereby both of said pistons in said cylinder pair rise and fall together, wherein each of said two pistons is operably installed in a single cylinder within said cylinder pair;

b) a crankcase, operably attached to said cylinder pair;

c) an intake manifold, attached to said cylinder pair;

d) a first inlet tube, having a first end fixedly attached to said crankcase and having an opening therein to permit a flow of air therebetween, and also having a second end fixedly attached to said intake manifold and having an opening therein to permit a flow of air therebetween;

e) a second inlet tube, having a first end fixedly attached to said crankcase and having an opening therein to permit a flow of air therebetween, and also having a second end fixedly attached to said intake manifold and having an opening therein to permit a flow of air therebetween;

f) a one-way valve, installed in said first end of said first inlet tube, to draw a quantity of air into a crankcase on the upstroke of the two pistons;

g) a first two-way valve operably installed in said intake manifold, in operable contact with said first inlet tube, wherein when said first two-way valve is in a first position, the cylinder pair is naturally aspirated through said intake manifold, and when said first two-way valve is in a second position, air entering into said intake manifold is directed into said crankcase through said first inlet tube during a compression stroke of one of cylinders in said cylinder pair; and h) a second two-way valve operably installed in said intake manifold in operable contact with said second inlet tube, wherein when said second two-way valve is in a first position, the cylinder pair is naturally aspirated through said intake manifold, and when said second two-way valve is in a second position, air is drawn from said crankcase into said intake manifold through said second inlet tube during an intake stroke of one of cylinders in said cylinder pair.

2. The internal combustion engine of claim 1 wherein said crankcase has a volume and further wherein said volume of said crankcase is two times a volume of air normally occupying one of said pair of cylinders.

3. The internal combustion engine of claim 1 wherein said cylinder pair operates on alternate ignition cycles, whereby when one cylinder of said cylinder pair is in the power stroke, the other cylinder in said cylinder pair is in the intake stroke.

4. A method of crankcase inducted self-supercharging of a four-cycle internal combustion engine having at least one cylinder pair having two pistons arranged in a 360-degree crank throw, whereby both of said pistons in said cylinder pair rise and fall together, wherein each of said two pistons is operably installed in a single cylinder within said cylinder pair; a crankcase, operably attached to said cylinder pair; an intake manifold, attached to said cylinder pair; a first inlet tube, having a first end fixedly attached to said crankcase and having an opening therein to permit a flow of air therebetween, and also having a second end fixedly attached to said intake manifold and having an opening therein to permit a flow of air therebetween; a second inlet tube, having a first end fixedly attached to said crankcase and having an opening therein to permit a flow of air therebetween, and also having a second end fixedly attached to said intake manifold and having an opening therein to permit a flow of air therebetween; a one-way valve, installed in said first end of said first inlet tube, to draw a quantity of air into a crankcase on the upstroke of the two pistons; a first two-way valve operably installed in said intake manifold, in operable contact with said first inlet tube, wherein when said first two-way valve is in a first position, the cylinder pair is naturally aspirated through said intake manifold, and when said first two-way valve is in a second position, air entering into said intake manifold is directed into said crankcase through said first inlet tube during a compression stroke of one of cylinders in said cylinder pair; and a second two-way valve operably installed in said intake manifold in operable contact with said second inlet tube, wherein when said second two-way valve is in a first position, the cylinder pair is naturally aspirated through said intake manifold, and when said second two-way valve is in a second position, air is drawn from said crankcase into said intake manifold through said second inlet tube during an intake stroke of one of cylinders in said cylinder pair; comprising the steps of:

a) drawing a quantity of air equal to two volumes of air into said crankcase through said first inlet tube on a first upstroke of said pistons;

b) moving the double volume quantity air in said crankcase from said crankcase into a first cylinder in said cylinder pair on a first downstroke of said pistons;

c) drawing a second quantity of air into said crankcase equal to two volumes of air in a second upstroke;

d) moving the double volume quantity air in said crankcase from said crankcase into a second cylinder in said cylinder pair on a second downstroke of said pistons; and e) repeating steps a, b, c, and d for each subsequent cycle of operation.

5. The method of claim 4 further comprising the steps of:

a) setting the first two-way valve is in said first position;

b) setting the second two-way valve in said first position and c) drawing a quantity of intake air directly into one of said cylinders in said cylinder pair through said intake manifold.

6. The method of claim 5 further comprising the steps of:

a) setting the first two-way valve is in said second position; and b) drawing a quantity of intake air into said crankcase, wherein said quantity of air is equal to a double volume of intake air.

7. The method of claim 5 further comprising the steps of:

a) setting the second two-way valve is in said second position; and b) drawing a quantity of intake air from said crankcase into one cylinder of said cylinder pair.

8. The method of claim 7 wherein a first quantity of intake air is moved into a first cylinder in said cylinder pair on a first cycle; and wherein a second quantity of intake air is moved into a second cylinder in said cylinder pair on a second cycle.

* * * * *